US006443780B2

(12) United States Patent
Wilbourn et al.

(10) Patent No.: US 6,443,780 B2
(45) **Date of Patent: *Sep. 3, 2002**

(54) CONDUCTOR ASSEMBLY FOR POTHEAD CONNECTOR

(75) Inventors: Phillip R. Wilbourn, Claremore, OK (US); Leonard M. Plummer, Midland; Don C. Cox, Roanoke, both of TX (US)

(73) Assignee: Baker Hughes Incorporated, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/378,905

(22) Filed: Aug. 23, 1999

(51) Int. Cl.[7] ..... H01R 13/42
(52) U.S. Cl. ..... 439/738
(58) Field of Search ..... 439/752, 695, 439/589, 275–279, 587–588, 205, 738, 737, 690

(56) References Cited

U.S. PATENT DOCUMENTS

| | | | | | |
|---|---|---|---|---|---|
| 2,073,268 | A | * | 3/1937 | Ray et al. | 439/738 |
| 2,925,578 | A | * | 2/1960 | Huff et al. | 439/589 |
| 3,241,095 | A | * | 3/1966 | Phillips | 439/205 |
| 3,308,316 | A | | 3/1967 | Pfahl | |
| 3,736,548 | A | | 5/1973 | Double | |
| 3,830,955 | A | | 8/1974 | Double | |
| 3,997,232 | A | | 12/1976 | Dunaway | |
| 4,053,196 | A | | 10/1977 | Dunaway | |
| 4,204,739 | A | | 5/1980 | Shoenleben | 339/75 |
| 4,546,300 | A | | 10/1985 | Shaikh | |
| 4,583,804 | A | | 4/1986 | Thompson | 339/60 |
| 4,859,200 | A | | 8/1989 | McIntosh et al. | 439/275 |
| 4,959,022 | A | * | 9/1990 | Neuroth | 439/589 |
| 5,113,101 | A | | 5/1992 | Liu et al. | |
| 5,221,214 | A | | 6/1993 | Martin | |
| 5,286,220 | A | | 2/1994 | Watson | 439/589 |
| 5,478,970 | A | | 12/1995 | Lawler et al. | 174/74 R |
| 5,670,747 | A | | 9/1997 | Lawler et al. | 174/74 R |
| 5,700,161 | A | * | 12/1997 | Plummer et al. | 439/587 |
| 5,704,799 | A | * | 1/1998 | Wood | 439/587 |
| 5,801,465 | A | | 9/1998 | Yamadai | |
| 6,071,148 | A | * | 6/2000 | Radliff et al. | 439/587 |

FOREIGN PATENT DOCUMENTS

| | | | |
|---|---|---|---|
| EP | 0660447 A1 | 6/1995 | H01R/13/436 |
| GB | 2306258 A | 4/1997 | H01R/13/533 |

* cited by examiner

*Primary Examiner*—Gary F. Paumen
*Assistant Examiner*—Felix O. Figueroa
(74) *Attorney, Agent, or Firm*—Bracewell & Patterson, L.L.P.

(57) ABSTRACT

An electric submersible pump is provided having a pothead connector for use to connect a downhole cable to an electric motor of the submersible pump. The pothead connector has a tubular housing having an upper and a lower end. The downhole cable has electrical conductors which are separately covered by insulation layers. Lead sheaths separately extend around each of the insulation layers to encase each of the electrical conductors. The downhole cable extends through the rearward end and into the tubular housing, and then is electrical connected to the electric motor through the lower end of the tubular housing. An insulating block is provided in the lower end of the tubular housing for separating electrical conductors in alignment for mating with a connector mounted to the electric motor. A conductor pin is secured to the insulating block and to each of the conductors. The conductor pin abuts against an internal shoulder within a bore of the insulating block. An insulating sleeve, which slides over each conductor pin and into the bore of the insulating block, is threadedly connected to the insulating block urging the conductor pin against the internal shoulder. A lead based alloy solder seal and epoxy layers are disposed within the tubular housing, intermediately between the rearward and lower ends.

15 Claims, 2 Drawing Sheets

CONDUCTOR ASSEMBLY FOR POTHEAD CONNECTOR

BACKGROUND OF THE INVENTION

The present invention relates in general to downhole electrical connectors for use in oil field applications, and in particular to a downhole pothead connector for connecting a motor lead to an electrical motor of a submersible pump assembly.

DESCRIPTION OF PRIOR ART

Electric submersible pumps have been used in oil wells to pump well fluids for many years. These types of prior art submersible pumps include electrical connectors for connecting the electric motors of the pumps to electrical conductors of downhole cables. These pumps are often used in corrosive environments such as wells that produce sour gas, and hydrogen sulfide ($H_2S$).

Electrical connectors for electric submersible pumps typically have elastomeric seals or pothead connectors. The hydrogen sulfide encountered in sour gas wells will permeate elastomeric seal materials and deteriorate these seals. This allows the gas to migrate back into the electrical connectors, corroding the connectors and seriously reducing the service life of downhole pothead connectors and pumps.

A separate problem encountered with pothead connections is the movement of conductors within the connector during installation and/or handling. The result of this movement is shear stress damage to the cable insulation and the insulation within the connector itself, either of which is likely lead to the failure of the electrical connection.

SUMMARY OF THE INVENTION

A pothead connector for use with an electric submersible pump is provided to connect a downhole cable to an electrical motor of the submersible pump.

The pothead connector has a tubular housing having an rearward end and a forward end. The downhole cable has electrical conductors that are separately covered by insulation layers. In the embodiment shown, lead sheaths separately extend around each of the insulation layers to encase and protect each of the electrical conductors. The downhole cable extends through the rearward end and into the tubular housing, and then is electrically connected to the electric motor through the forward end of the tubular housing.

An insulating block is provided in the forward end of the tubular housing for separating and holding the electrical conductors in alignment and to prevent movement of the conductors within the housing. A bore is provided through the insulating block for each of the conductors. The bore is provided with an annular shoulder for abutting against a flange that radially extends from a conductor pin and is further provided with threads for engaging with an insulating sleeve.

A conductor pin is provided that is at least partially inserted into the bore of the insulating block and is fixed to the terminal end of the conductor. The conductor pin also has an opening for receiving an electrical lead from a downhole pump motor. An insulating sleeve is provided having a bore which is configured to slide over the conductor pin and abut against the flange of the conductor pin urging the pin against the annular shoulder within the insulating block. The insulating sleeve is further provided with external threads for engaging with the threads of the insulating block when the sleeve is inserted into the bore of the insulating block.

In the embodiment shown, a lead based alloy solder seal disc is disposed within the tubular housing, intermediately between the rearward and forward ends. The solder seal extends between and is wetted to the protective lead sheaths and an interior perimeter of the tubular housing to seal therebetween. The seal disc is alloyed so as to have substantially no contraction as it cools and solidifies. An epoxy layer extends between the cable and the interior perimeter of the tubular housing, adjacent to an rearward end of the lead based seal disc. A second epoxy layer is disposed within the tubular housing on a forward side of the lead based alloy seal, opposite from the rearward side. Fasteners secure the tubular housing to the electric motor.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
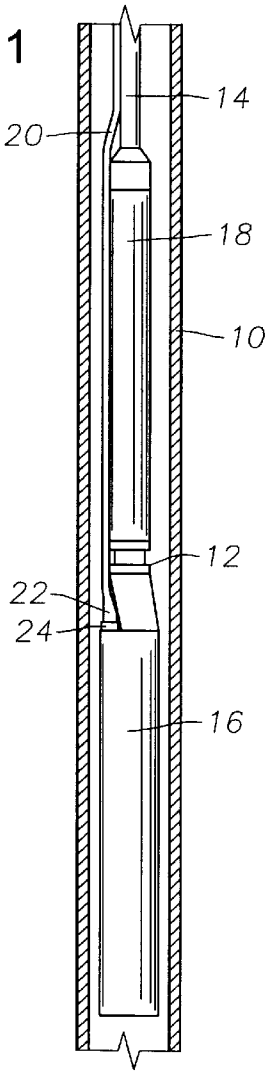
FIG. 1 is an elevational view of a well within which an electrical submersible pump is disposed.

FIG. 1 is an elevational section view of well 10 having electric submersible pump 12 disposed therein, mounted to tubing 14. Pump 12 includes an electric motor 16 and a pump section, centrifugal pump assembly 18. Cable 20 extends from a surface downhole, terminating in a motor lead to provide power to electric motor 16. Pothead connector 22 is mounted to the motor lead of cable 20, and electrically connects and secures the motor lead of cable 20 to a tubular housing 24 of motor 16.

Figure 2:
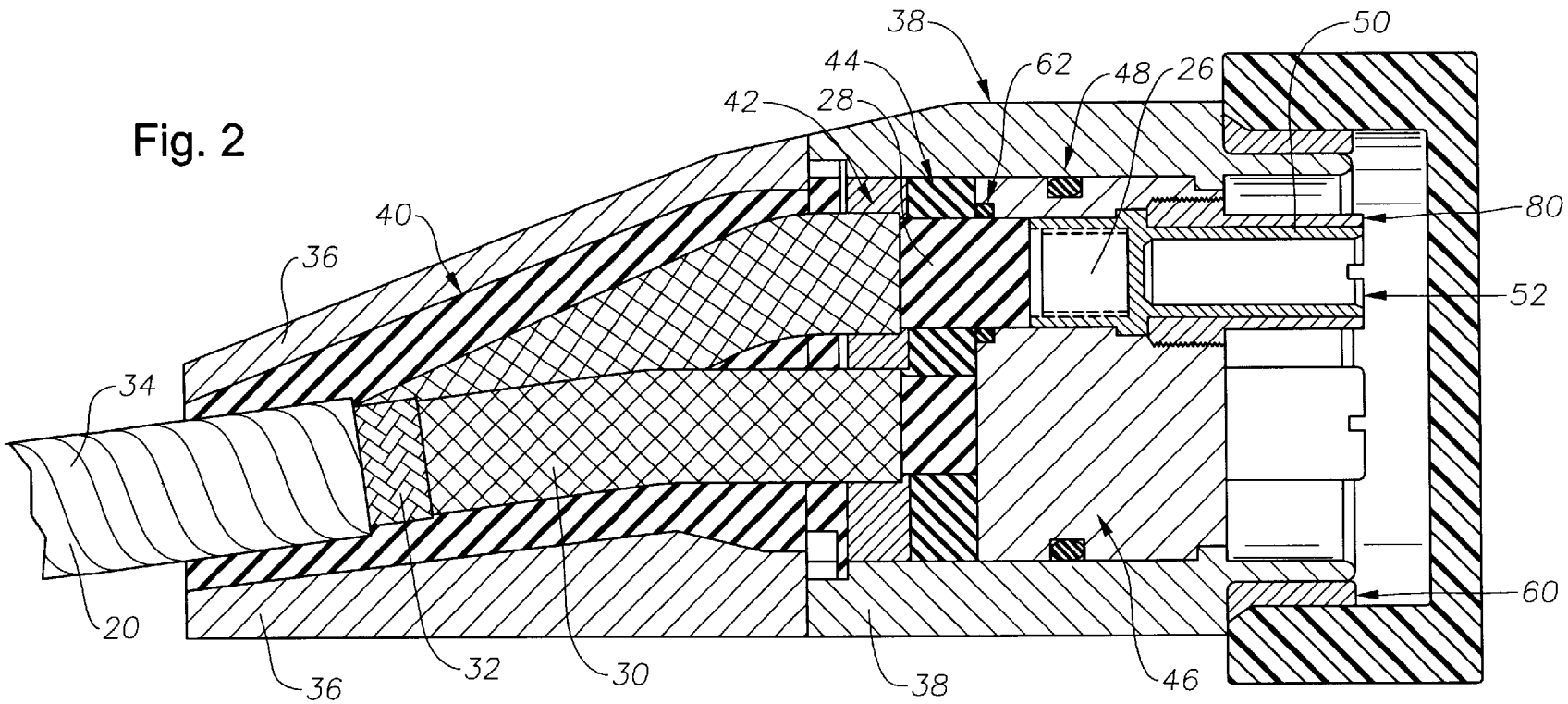
FIG. 2 is a longitudinal cross sectional view depicting the interior of the pothead connector made according to the present invention, mounted to the terminal end of the down hole electric cable.

Referring to FIG. 2, cable 20 is a flat cable containing three conductors 26. Each conductor 26 is surrounded by a layer 28 of dielectric material to protect and insulate the conductors from one another. A lead sheath 30 is applied over each of the insulated conductors and mesh nylon braid 32 is applied over the lead sheaths. Encasing and protecting the elements of cable 20 is metal armor 34.

Connector 22 has a cap 36 that joins a cylindrical base 38. Cap 36 has a tapered tubular end which extends around the exterior of armor 34 of cable 20. The forward end of cap 36 is cylindrical. The interior of cap 36 is filled with epoxy 40, which acts as a retaining means to secure conductors 26 within cap 36 in alignment for extending into base 38. Epoxy 40 is a type of epoxy which is rated for high temperature service. The interior surface of the tapered tubular end of cap 36 has a conical profile, with the rearward end periphery being smaller than the forward end periphery. After cap 36 is fastened to base 38 and layer of epoxy 40 is cured, epoxy 40 will prevent movement of cap 36 and base 38 forward relative to armor 34 of cable 20.

As shown in FIG. 2, armor 34 has been stripped back from the terminal end of cable 20, so that armor 34 has a terminal end which is enclosed within the tapered portion of cap 36. Preferably, mesh nylon braid 32 will also be stripped to have an end which is enclosed within cap 36 between the terminal end of armor 34 and the end of lead sheaths 30.

Lead sheaths 30 are preferably stripped from around insulation layers 28 far enough from the terminal end of cable 20 so that sheaths 30 extend through cap 36 to intermediate positions within base 38. A metal seal disc 42 is soldered in base 38 near its rearward end, with epoxy 40 being in contact with a rearward side of seal disc 42. Lead sheaths 30 extend at least partially through metal seal disc 42. This exposes enough of the exterior surface of lead sheaths 30 so that the lead based seal disc 42 will wet to, that is bond directly to, lead sheaths 30.

The metals that are combined to form seal disc 42 include various alloys of lead combined with tin, antimony, bismuth and mixtures of the same. The objective of the formulation for seal disc 42 is to obtain a mixture that will exhibit minimal contraction as the molten metals solidify. Further, it is likewise desirable that the metal seal disc be made from a formulation that does not experience significant expansion or contraction under operative conditions downhole. It is preferable that such a formulation will comprise 75% lead alloy, 15% antimony and 10% tin.

An epoxy layer 44 is located on the forward side of seal disc 42. Preferably, lead sheaths 30 do not extend all the way through disc 42 so that at least a portion of the exterior surfaces of insulation layers 28 are exposed to the epoxy layer 44. The epoxy of layer 44 is selected so that it will bond directly to insulation layers 28.

Still referring to FIG. 2, an insulating block 46 formed of PEEK, polyether ether keytone, is mounted at the forward end of base 38. Insulating block 46 is fixed within base 38 to prevent movement of the block within the tubular housing. O-ring seal 48 is provided around insulating block 46. O-ring 48 is preferably made of VITON, a trademark of E. I. Du Pont de Nemours & Company. Insulating block 46 is provided with a plurality of bores therethrough for receiving insulated conductors 26 and aligning them with the electrical leads of a pump motor or other downhole device requiring electrical power or control.

The forward ends of electrical insulation layers 28 may be disposed within insulating block 46, as shown in FIG. 2. Insulation layers 28 extend through the metal seal disc 42 to prevent conductors 26 from shorting. Insulation layers 28 will preferably extend through epoxy layer 44 so that the epoxy of layer 44 will bond directly to insulation layers 28.

At the forward end of base 38, insulation 28 is stripped from conductors 26 provide a terminal end of cable 20. Connector pins 50 are soldered over the terminal ends of conductors 26. Connector pins 50 are provided for mating with electrical connectors in electric motor 16 of submersible pump 12 (shown in FIG. 1).

Epoxy layer 44 fills in the space between insulating block 46 and lead based seal disc 42. Epoxy layer 44 is a type of epoxy rated for high temperature service. Epoxy layer 44 is adjacent to and extends across a forward face of solder seal 42, and preferably bonds to the interior of base 38 and insulation 28 of electrical conductors 26 when cured in situ. Epoxy layer 44 provides a backing layer for supporting seal disc 42 against high pressures encountered within wells.

Lead based seal disc 42 provides a sealing layer which extends adjacent to the rearward face of epoxy layer 44. Base 38, lead sheaths 30 and lead based seal disc 42 are to be selected of compatible corrosion resistant materials so that seal disc 42 will wet to the interior perimeter of base 38 and the exterior surface of lead sheaths 30. The material for seal disc 42 should also chosen so that the integrity of the seal is not lost due to contraction and/or expansion of the seal disc 42 under the extreme temperatures that may be encountered downhole.

Sealing boot 60 extends around a forward lip of base 38 and provides a seal between base 38 and electric motor 16 of pump 12. Boot 60 is made from E.P.D.M. (ethylene propylene diene monomer) O-rings 62 separately seal between insulating block 46 and insulation 28 on conductors 26 proximate the terminal ends of cable 20. O-rings 62 are preferably made of VITON.

Figure 3:
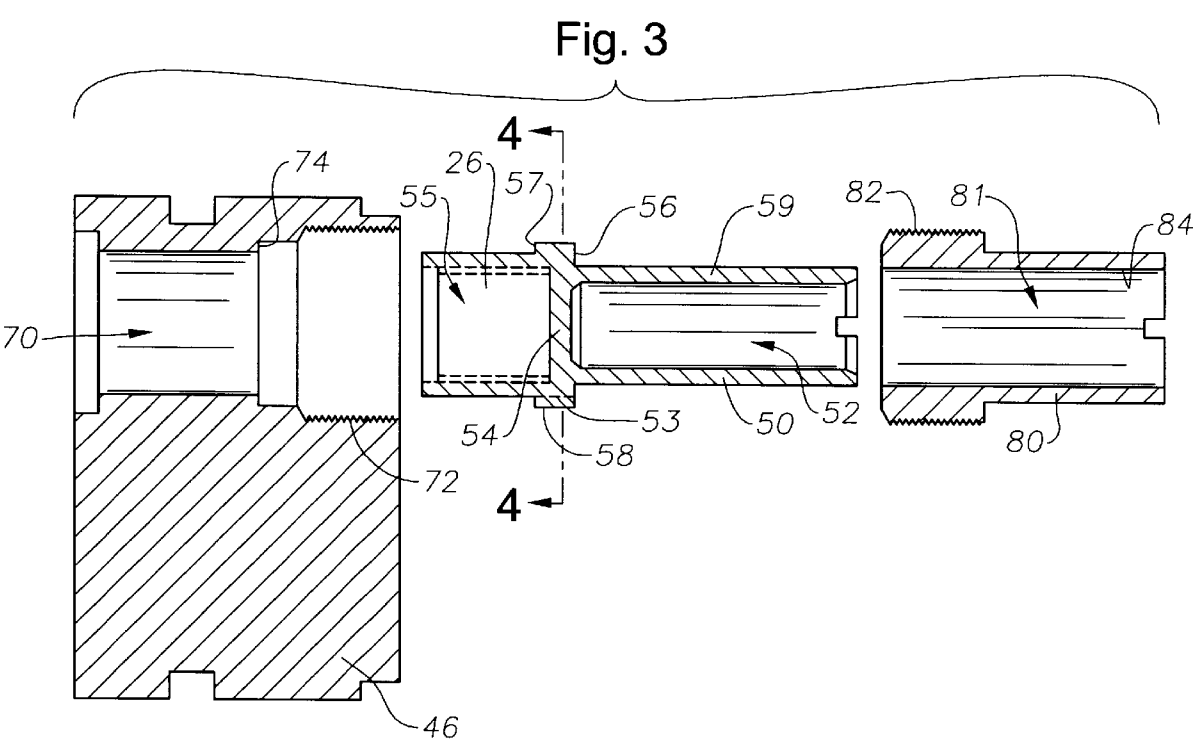
FIG. 3 is a partially exploded cross sectional view of the insulating block and conductor pin and insulative sleeves of the present invention.

Referring to FIG. 3, insulating block 46, is provided with bore 70 for receiving conductor 26, conductor pin 50 and insulating sleeve 80. Bore 70 is not uniform but is provided with annular forward facing shoulder 74 and internal threads 72.

Conductor pin 50 is preferably an elongated cylindrical member with a radially extending flange 58 having rearward and forward shoulders, 57 and 56, respectively. A cylindrical forward portion 59 extends forward from flange 58. The terminal end of conductor 26 is fixed in a rearward facing cavity or a first opening 55 of pin 50 by a solder weld. As described above, it is preferable that insulation 28 on conductor 26 be stripped back so that conductor 26 may be inserted into and affixed with conductor pin 50. However, sufficient insulation should be left in place so that as cable 20 is inserted into insulating block bore 70, a portion of insulation 28 is inserted into bore 70 along with conductor 26. Preferably, insulation 28 will abut against rearward end of conductor pin 50. Conductor pin 50 has a forward cylindrical cavity or a second opening 52 for receiving an electrical pin of motor 16 (not shown). A partition 54 is located intermediate between cavities 55 and 52. Flange 58 is located at partition 54.

Figure 4:
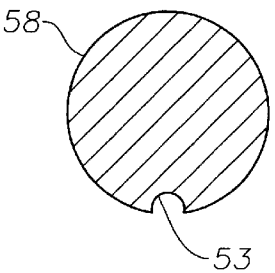
FIG. 4 is a sectional view of the conductor pin of FIG. 3, taken along the line 4—4 of FIG. 3.

An insulating sleeve 80 made of a dielectric material similar to and compatible with the material of insulating block 46 inserts over the forward portion of conductor pin 50. Insulating sleeve 80 has bore 81 therethrough, the bore having a sufficient diameter that sleeve walls 84 will receive and slide over the forward portion 59 of conductor pin 50. Insulating sleeve 80 has external threads 82 on a rearward portion for engaging with the internal threads 72 of bore 70 of insulating block 46. Threads 82 on insulating sleeve 80 and threads 72 on insulating block 46 are coarse to facilitate assembly even when there is misalignment during the manufacture of the pothead connector. Further, the use of coarse threads allows for fluid communication between insulating sleeve 80 and insulating block 46 even when these elements are threadedly engaged. An axial groove 53, shown in FIG. 4, is formed in flange 58 to provide fluid communication from threads 72 rearward to o-ring seal 62. In addition, coarse threads 82 and 72 impose a long tracking distance from the conductors 26 to the nearest metal surface within the pothead, thereby increasing the distance to ground and the electrical strength of the pothead connector.

With reference to FIG. 2, assembly of the pothead connector onto cable 20 is now described. Cap 36 is first placed over the terminal end of cable 20 and pushed onto cable 20, away from the terminal end. Components of cable 20 are then stripped from the terminal end.

The first component of cable 20 which is stripped from the terminal end is metal armor 34. Armor 34 is stripped far enough from terminal end so that electrical connectors 26 may be separated within cap 36 and aligned for extending into base 38, for passing into the bores 70 of insulating block 46.

The next component stripped from cable 20 is mesh nylon braid 32. Mesh nylon braid 32 is stripped from around lead sheaths 30. Lead sheaths 30 provide a surface to which lead based seal disc 42 will wet. Lead sheaths 30 extend within base 38 beyond the forward ends of the lead based seal disc, into the region within base 38 where epoxy layer 44 will be placed.

Lead sheaths 30 will be removed a sufficient distance so that insulation 28 is exposed within the region within base 38 in which epoxy layer 44 is placed. Insulation 28 is preferably made of a material to which epoxy 44 will bond, such as E.P.D.M. Insulation 28 is stripped from conductors 26 at a distance so that electrical conductors 26 will extend within insulating block 46. The terminal end of insulation 28 will be within insulating block 46.

It is preferable that the elements shown in FIG. 3 be preassembled. Specifically, conductor 26 should be soldered in place within opening 55 of conductor pin 50. Conductor pin 50 is then inserted into bore 70 of insulating block 46 until rearward surface 57 of flange 58 abuts against annular shoulder 74 and o-ring 62 extends between insulation 28 and insulating block 46. Insulating sleeve 80 is then inserted over conductor pin 50 into bore 70 and threads 82 are engaged with threads 72. Preferably, the insulating sleeve 80 will be threaded into bore 70 until its rearward surface abuts against forward shoulder 56 of flange 58, urging the conductor pin 50 against annular shoulder 74. In this way, conductor pin 50 is releasably affixed within the insulating block 46 against axial movement in either direction. Conductors 26 are prevented from movement within the housing due to their connection to conductor pins 50 and their immobilization between the insulating block 46 and insulating sleeve 80. Insulating block 46 is then placed within base 38, with o-ring 48 sealing to an interior perimeter of the housing between insulating block 46 and base 38.

A liquid epoxy mixture, a catalyst and a resin, is then poured into the rearward end of base 38 for curing to provide epoxy layer 44. Epoxy layer 44 extends around electrical conductors 26, up against the inner face of insulating block 46, and preferably bonds to both insulation 28 and the interior of base 38. Epoxy layer 44 will stabilize conductors 26 and provide a seal which is impervious to hydrogen sulfide gas. A space is left within the rearward end of base 38 for adding lead based seal disc 42 next to the inner face of epoxy layer 44.

After epoxy layer 44 is placed within base 38, base 38 is heated to a high enough temperature to assure that lead based seal disc 42 will wet to base 38. Heating base 38 will also partially cure epoxy layer 44. The portions of lead sheaths 30 to which seal disc 42 will wet may also be heated to assure wetting of the lead based seal disc 42 to lead sheaths 30. Portions of lead based alloy disc 42 are melted and then placed within base 38, within the rearward end of base 38. Seal disc 42 will wet to both the interior perimeter of base 38 and to exterior surfaces of lead sheaths 30 of cable 20. Since lead based seal disc 42 wets to and extends across both the interior perimeter of base 38 and the exterior surfaces of lead sheaths 30, disc 42 provides a fluid barrier through which hydrogen sulfide gas will not permeate.

If seal disc 42 extends into the recess at the rearward end of base 38, it must either be cleaned from within recess by machining, or a lip which extends from the forward end of cap 36 must be ground off of cap 36 prior to mounting cap 36 to base 38. Cap 36 then slides outward on cable 20 and mates against the rearward end of base 38. Bolts (not shown) secure cap 36 to base 38.

Liquid epoxy is then poured into cap 36 to provide epoxy layer 40 within cap 36. Epoxy layer 40 holds electrical conductors 26 in position within cap 36. Epoxy layer 40 will seal against gas migration, and will also stabilize conductors 26 to prevent them from moving around and damaging seal disc 42.

Epoxy layers 40 and 44 are then cured. Epoxy layer 44 is initially partially cured by heating base 38 to a sufficient temperature to assure that lead bases seal disc 42 will wet to base 38. Then, epoxy layers 40 and 44 are both cured by heating to 175 degrees Fahrenheit (80 deg. C.) for 1.5 hours, and then heating to 275 degrees Fahrenheit (135 de. C.) for 45 minutes.

After pothead connector 22 is cooled, sealing boot 60 is secured around a forward lip of base 38 and provides a seal between base 38 and the housing of electric motor 16 of pump 12. After being connected to motor 16, dielectric oil is pumped into motor 16. The oil migrates around pin 50 between threads 82 and 72, through channel 53 into bore 70, and up against o-ring seal 62. This eliminates void spaces that could later cause problems due to high pressure differential between the exterior of connector 22 and the internal spaces in connector 22. In use, the dielectric oil is maintained at a pressure equal to the external hydrostatic pressure by a pressure equalizer.

The present invention has several advantages over prior art electric submersible pumps having pothead connectors in hostile service applications, such as sour gas wells. The connector pin assembly is locked against axial movement. The coarse threads and groove in the flange of the conductor pin allow filling of all voids with a dielectric fluid. Further the coarse threads between the insulating elements provides an extended tracking distance within the connector.

The layer of lead based alloy solder seals between the tubular housing and the lead sheaths encasing the electrical conductors, providing a seal which is impervious to gas migration in hostile environments, such as in hydrogen sulfide in sour gas wells. Further the lead seal does not contract while the formulation of metals solidifies during manufacture. The epoxy layers stabilize the conductors so that they do not move around and damage the lead based alloy layer providing the seal.

A conductor pin assembly is also provided to maintain the alignment of the conductors and to prevent their movement within the housing. Movement of the conductors within the housing imposes shear stress on the conductors and causes damage to the conductor insulation and the insulating members within the housing. The pin assembly provides a insulating block that is fixed to the housing and that has a bore for receiving the conductors, conductor pins and insulting sleeves. The conductors are fixed to the conductor pins and the pins are releasably held between the insulating block and the insulting sleeves, thus preventing movement of the conductors within.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. In a submersible well pump assembly having an electrical motor, an electrical cable extending from the surface, an improved connector for connecting the cable to the motor, comprising:

a tubular housing;

an insulating block stationarily fixed within the housing, the insulating block having a plurality of bores therethrough, the bore having a shoulder and a set of threads;

a conductor pin of electrically conductive material at least partially disposed within each of the bores of the insulating block, each of the pins having a rearward facing cavity for receiving and fixedly retaining a cable conductor, and a forward portion that has a fully cylindrical outer surface and is adapted to engage an electrical conductor for a submersible pump motor, each of the pins having a shoulder that abuts the shoulder in the bore;

a plurality of retainers former of insulation material each of which has a threaded portion that secures to the set of threads in one of the bores in the insulating block and retains the shoulder of the pin in abutment with the shoulder in the bore relative to the insulating block to prevent any movement of the pin relative to the housing, each of the retainers having a sleeve portion extending forward from the threaded position, the sleeve portion being fully cylindrical and extending closely around the fully cylindrical outer surface of one of the pins; and wherein the threaded portion of each of the retainers has a larger outer diameter than the sleeve portion, defining a forward facing shoulder at an intersection between the threaded portion and the sleeve portion that is substantially flush with a forward end of the insulating block.

2. The connector of claim 1, wherein the sleeve portion extends flush with a forward end of one of the pins.

3. The connector of claim 1, wherein the shoulder of each of the pins is located on external flange of the pin.

4. The connector of claim 1, further comprising a seal disk located in the housing rearward of the insulating block, the seal disk sealed around the cable and to the housing, the seal disk being formed of a metal having substantially no coefficient of contraction.

5. The connector of claim 1, wherein each of the retainers has a constant diameter bore extending through the threated portion and the sleeve portion.

6. The connector of claim 1, wherein the shoulder of each of the pins is fully circular, and the threaded portion of each of the retainers has a fully circular rearward facing shoulder that abuts the shoulder of one of the pins.

7. A connector for providing an electrical connection between an electrical cable and a submersible pump motor comprising:

a tubular housing;

an insulating block stationarily fixed within the housing, the insulating block having a plurality of bores, each of the bores having a rearward portion and a forward portion separated by a forward facing shoulder, each of the forward portions containing threads;

a conductor pin of electrical conductive material partially disposed within each of the bores of the insulating block, each of the pins having a rearward portion extending through the rearward portion of one of the bores for receiving and fixedly retaining a cable conductor, each of the pins having an outer surface with a radially extending flange that abuts one of the forward facing shoulders, and each of the pins having a fully cylindrical forward portion for engaging an electrical conductor from a submersible pump motor;

a plurality of insulating sleeves, each of the insulating sleeves having a bore of sufficient diameter to receive the forward portion of one of the conductor pins and a fully cylindrical forward portion that closely receives the fully cylindrical forward portion of one of the pins, each of the insulating sleeves having a threaded portion with an outer surface bearing threads that engage the threads within one of the bores in the insulating block, and each of the insulating sleeves having a rearward end that abuts and forces one of the flanges of one of the conductor pins against one of the forward facing shoulders in one of the bores of the insulating block, therebuy preventing any movement of the pins relative to the housing; and wherein the threaded portion of each of the reainers has a larger outer diameter than the forward portion of the sleeve, defining a forward facing shoulder at an intersection between the threaded portion and the forward portion that is substantially flush with a forward end of the insulating block.

8. The connector of claim 7, further comprising a seal disk located in the housing rearward of the insulating block, the seal disk sealed around the cable and to the housing, the seal disk being formed of a metal having substantially no coefficient of contraction.

9. The connector of claim 8, wherein each of the pins has a constant outer diameter from the flange to a forward end.

10. The connector of claim 8, wherein the flange of each of the pins is fully circular, and the rearward end of each of the retainers is a fully circular shoulder that abuts the flange of one of the pins.

11. The connector of claim 7, wherein each of the insulating sleeves has a forward end that is substantially flush with a forward end of one of the conductor pins.

12. The connector of claim 7, further comprising:

a seal disk of metal located rearward of the insulating block, the seal disk sealed around the cable and to the housing; and a layer of epoxy between the seal disk and the housing.

13. The connector of claim 7, wherein each of the conductor pins has a rearward receptacle for receiving and connecting to one of the cable conductors and a forward receptacle for plugging engagement with one of the electrical conductors from the motor, the reward and forward receptacles being separated by a partition, and wherein the flange is located at the partition.

14. The connector of claim 7, wherein each of the retainers has constant diameter bore extending through the threaded portion and the forward portion.

15. A connector for providing an electrical connection between an electrical cable and a submersible pump motor comprising:

a tubular housing;

an insulating block stationarily fixed within the housing, the insulating block having a plurality of bores, each of the bores having a rearward portion and a forward portion separated by a forward facing fully circular shoulder, each of the forward portions containing threads;

a conductor pin of electrical conductive material partially disposed within each of the bores of the insulating block, each of the pins having a rearward portion extending through the rearward portion of one of the bores for receiving and fixedly retaining a cable conductor, each of the pins having a radially extending fully circular flange that abuts one of the forward facing shoulders, and each of the pins having a fully cylindrical forward portion for engaging an electrical conductor from a submersible pump motor, each of the pins having a constant outer diameter in the forward portion from the flange to a forward end;

a plurality of insulating sleeves, each of the insulating sleeves having a fully cylindrical forward portion that closely receives the fully cylindrical forward portion of one of the pins, each of the insulating sleeves having a rearward portion with an outer diameter that is larger than the forward portion of the sleeve and bears threads that engage the threads within one of the bores in the insulating block, the rearward portion of the insualting sleeve having a forward facing shoulder at the intersection of the rearward portion with the forward portion that is substantially flush with a forward end of the insulating block, and each of the insulating sleeves having a rearward end with a circular shoulder that abuts and forces one of the flanges of one of the conductor pins against one of the forward facing shoulders in one of the bores of the insulating block, thereby preventing any movement of the pins relative to the housing.

* * * * *

UNITED STATES PATENT AND TRADEMARK OFFICE

CERTIFICATE OF CORRECTION

PATENT NO. : 6,443,780 B2
DATED : September 3, 2002
INVENTOR(S) : Phillip R. Wilbourn et al.

It is certified that error appears in the above-identified patent and that said Letters Patent is hereby corrected as shown below:

Title page,
Item [57], ABSTRACT,
Line 10, delete “electrical” and insert -- electrically --

Column 1,
Line 32, after “likely” insert -- to --
Line 38, delete “an” and insert -- a --

Column 3,
Line 52, after “26” insert -- to --

Column 4,
Line 4, after “also” insert -- be --

Signed and Sealed this

Twenty-eighth Day of January, 2003

JAMES E. ROGAN
*Director of the United States Patent and Trademark Office*